US012116876B2

(12) United States Patent
Damm et al.

(10) Patent No.: US 12,116,876 B2
(45) Date of Patent: Oct. 15, 2024

(54) OPERATION OF A RECIRCULATION CIRCUIT FOR A FLUID PUMP OF A HYDRAULIC FRACTURING SYSTEM

(71) Applicant: Caterpillar Inc., Peoria, IL (US)

(72) Inventors: Shawn M. Damm, Houston, TX (US); Yuesheng He, Sugar Land, TX (US); Sri Harsha Uddanda, Cypress, TX (US); Todd Ryan Kabrich, Tomball, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/168,255

(22) Filed: Feb. 13, 2023

(65) Prior Publication Data

US 2024/0271514 A1 Aug. 15, 2024

(51) Int. Cl.
*E21B 43/267* (2006.01)
*E21B 43/26* (2006.01)

(52) U.S. Cl.
CPC ..... *E21B 43/2607* (2020.05); *E21B 43/267* (2013.01)

(58) Field of Classification Search
None
See application file for complete search history.

(56) References Cited

U.S. PATENT DOCUMENTS 4,176,064 A * 11/1979 Black ..... E21B 43/267 210/512.1
4,953,097 A * 8/1990 Crain ..... G05B 15/02 700/265
2019/0055805 A1* 2/2019 Lewis ..... C09K 8/80
2020/0048985 A1* 2/2020 Oehler ..... B65G 27/16
2021/0178345 A1* 6/2021 Arceneaux ..... B01F 35/7176
2021/0222054 A1* 7/2021 Deysarkar ..... C09K 8/725
2022/0065237 A1* 3/2022 Cook ..... F04B 17/06
2022/0316306 A1* 10/2022 Liu ..... E21B 43/267
2022/0316308 A1* 10/2022 Arceneaux ..... E21B 43/267

FOREIGN PATENT DOCUMENTS

CN 104712304 B 6/2015
CN 206785369 U 12/2017
CN 206819105 U 12/2017
CN 208858998 U 5/2019

* cited by examiner

*Primary Examiner* — Matthew R Buck
*Assistant Examiner* — Douglas S Wood
(74) *Attorney, Agent, or Firm* — Harrity & Harrity, LLP

(57) ABSTRACT

A control system may include a recirculation circuit configured to direct fluid from an outlet of a fluid pump of a hydraulic fracturing system to an inlet of the fluid pump. The control system may include a control valve in the recirculation circuit. The control system may include a controller configured to cause opening of the control valve to cause the fluid to flow through the recirculation circuit at a first time when proppant is being added to the fluid. The controller may be configured to cause, after closing of the control valve and at a second time when the proppant is no longer being added to the fluid, re-opening of the control valve to cause the fluid to flow through the recirculation circuit to flush the recirculation circuit of the proppant.

20 Claims, 3 Drawing Sheets

OPERATION OF A RECIRCULATION CIRCUIT FOR A FLUID PUMP OF A HYDRAULIC FRACTURING SYSTEM

TECHNICAL FIELD

The present disclosure relates generally to fluid pumps and, for example, to operation of a recirculation circuit for a fluid pump of a hydraulic fracturing system.

BACKGROUND

Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids. Hydraulic fracturing may be performed in multiple discrete stages. Each stage may include a starting portion in which pure hydraulic fracturing fluid (e.g., water, liquid carbon dioxide, or the like) is pumped into the wellbore to initiate fissure formation, a middle portion in which proppant (e.g., sand) and other additives are blended into the hydraulic fracturing fluid being pumped into the wellbore, and an ending portion in which the pure hydraulic fracturing fluid is again pumped to flush the proppant from flow components of the hydraulic fracturing system. The proppant may be added to the hydraulic fracturing fluid to fill fissures that are generated by the hydraulic fracturing, thereby keeping the fissures open after pumping has stopped.

Proppant used in hydraulic fracturing fluid may accumulate in flow components of the hydraulic fracturing system (referred to as "sand packing"). The accumulation of proppant may restrict or block fluid flow, thereby impairing the functionality of the hydraulic fracturing system. Manual methods involving disassembly and cleaning of the hydraulic fracturing system are commonly employed to resolve proppant accumulation. However, these manual methods are time consuming and require the hydraulic fracturing system to be shut down.

The control system of the present disclosure solves one or more of the problems set forth above and/or other problems in the art.

SUMMARY

A pump system of a hydraulic fracturing system may include a fluid pump having an inlet and an outlet. The pump system may include a recirculation circuit configured to direct fluid from the outlet of the fluid pump to the inlet of the fluid pump. The pump system may include a control valve in the recirculation circuit. The pump system may include a controller configured to cause opening of the control valve to cause the fluid to flow through the recirculation circuit. The controller may be configured to identify an addition of a proppant to the fluid while the control valve is open. The controller may be configured to identify, after closing of the control valve, that the proppant is no longer being added to the fluid. The controller may be configured to cause, based on identifying the addition of the proppant to the fluid, re-opening of the control valve, while the proppant is no longer being added to the fluid, to cause the fluid to flow through the recirculation circuit to flush the recirculation circuit of the proppant.

A control system may include a recirculation circuit configured to direct fluid from an outlet of a fluid pump of a hydraulic fracturing system to an inlet of the fluid pump. The control system may include a control valve in the recirculation circuit. The control system may include a controller configured to cause opening of the control valve to cause the fluid to flow through the recirculation circuit at a first time when proppant is being added to the fluid. The controller may be configured to cause, after closing of the control valve and at a second time when the proppant is no longer being added to the fluid, re-opening of the control valve to cause the fluid to flow through the recirculation circuit to flush the recirculation circuit of the proppant.

A method may include causing, by a controller, an initiation of pumping of fluid by a fluid pump of a hydraulic fracturing system at a first time of a hydraulic fracturing stage when a proppant is being added to the fluid. The method may include causing, by the controller and based on the initiation of pumping of the fluid, opening of a control valve to cause the fluid to flow through a recirculation circuit that directs the fluid from an outlet of the fluid pump to an inlet of the fluid pump. The method may include causing, by the controller and after opening of the control valve, closing of the control valve. The method may include receiving, by the controller and at a second time of the hydraulic fracturing stage when the proppant is no longer being added to the fluid, a request to flush the recirculation circuit. The method may include causing, based on the request, re-opening of the control valve to cause the fluid to flow through the recirculation circuit to flush the recirculation circuit of the proppant.

DETAILED DESCRIPTION

Figure 1:
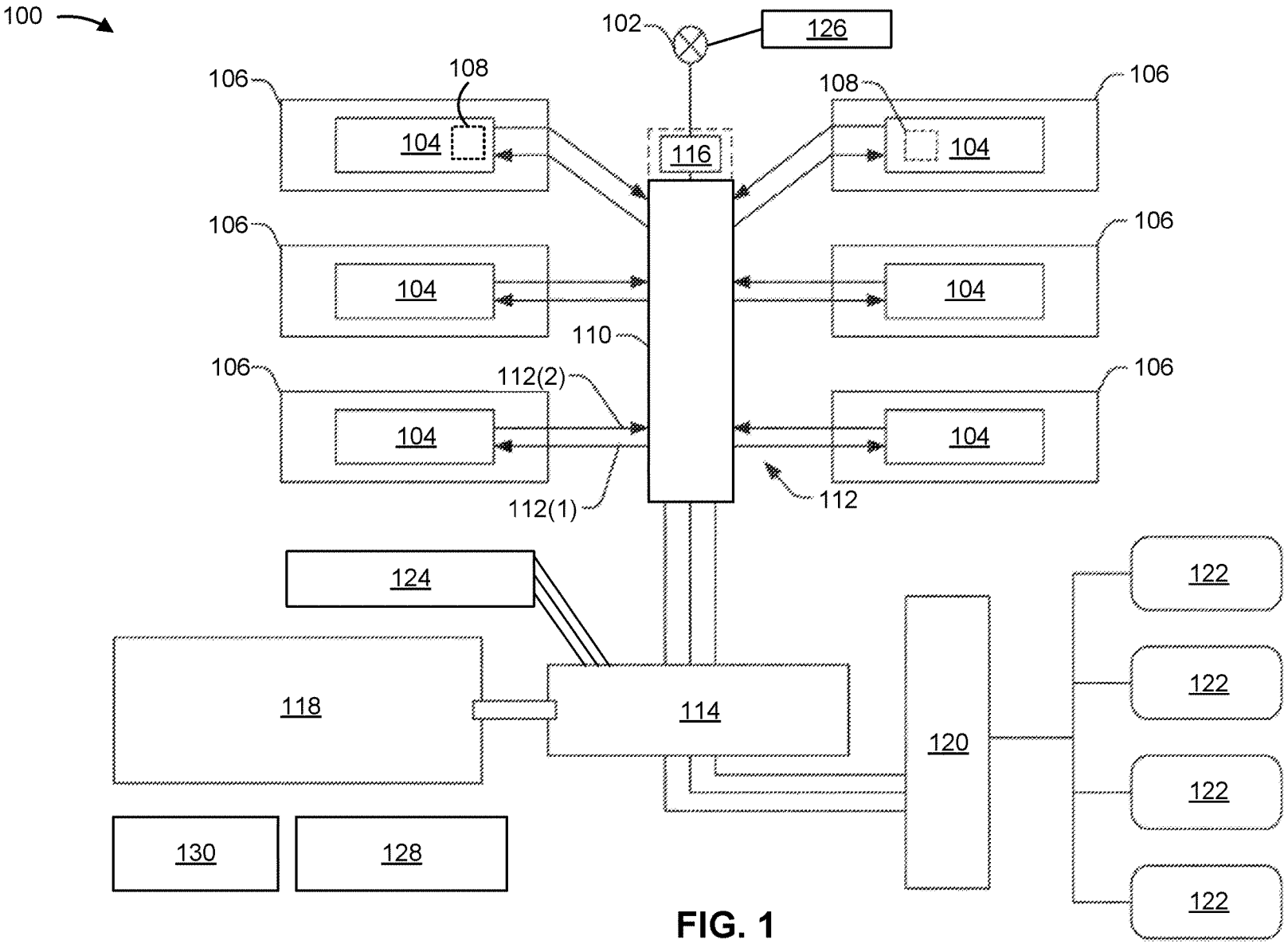
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. Hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). Each of the pump systems 104 may also include at least one prime mover for a fluid pump 108, such as an engine or a motor, which may share a housing with the fluid pump 108. The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. For example, each fluid pump 108 may be configured to discharge fluid to the manifold 110. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other types of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 may be a system-wide controller for the hydraulic fracturing system 100 or a pump-specific controller for a pump system 104. The controller 130 may be communicatively coupled (e.g., by a wired connection or a wireless connection) with one or more of the pump systems 104. The controller 130 may also be communicatively coupled with other equipment and/or systems of the hydraulic fracturing system 100. The controller 130 may include one or more memories and/or one or more processors. In some implementations, the controller 130 may be or may include a proportional-integral-derivative (PID) controller.

As indicated above, FIG. 1 is provided as an example. Other examples may differ from what is described with regard to FIG. 1.

Figure 2:
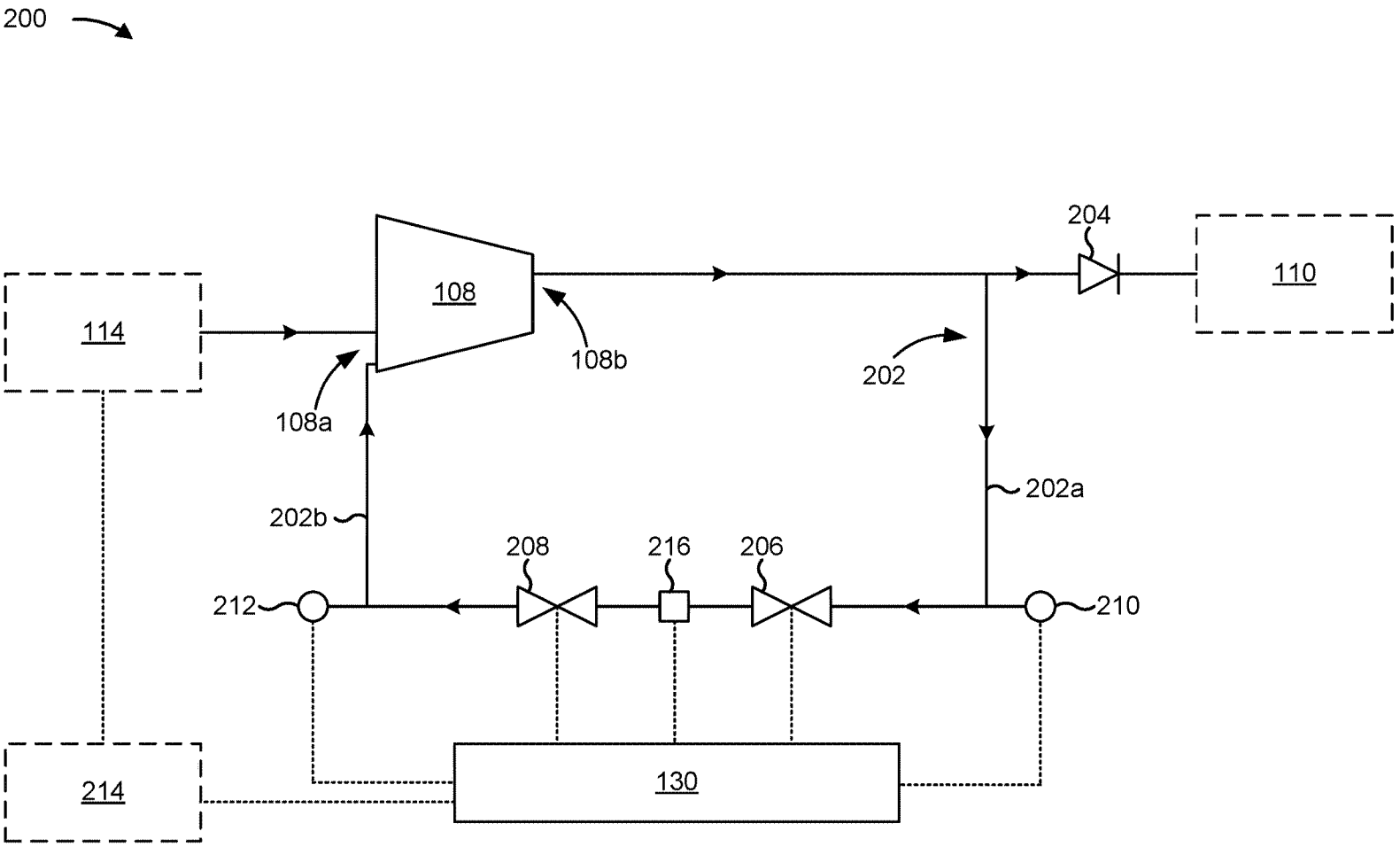
FIG. 2 is a diagram illustrating an example control system.

FIG. 2 is a diagram illustrating an example control system 200. The control system 200 may include one or more components of the hydraulic fracturing system 100, as described herein. In some examples, the control system 200 may be included in a pump system 104 of the hydraulic fracturing system 100.

As shown in FIG. 2, the control system 200 includes a fluid pump 108, the controller 130 (e.g., a pump-specific controller for the pump system 104), a recirculation circuit 202, a check valve 204, a control valve 206, a choke valve 208, a first pressure sensor 210 (referred to herein as a discharge pressure sensor 210), and/or a second pressure sensor 212 (referred to herein as a suction pressure sensor 212). The fluid pump 108 may receive fluid (e.g., hydraulic fracturing fluid) from the blender 114. At one or more times in a hydraulic fracturing stage, the blender 114 may add proppant to the fluid. An additional controller 214 associated with the blender 114 (e.g., that provides control of the blender 114) may be communicatively coupled with the controller 130 (e.g., by a wired connection or by a wireless connection). The fluid pump 108 may be configured to pressurize the fluid and discharge the pressurized fluid to the manifold 110 (e.g., via the check valve 204) and/or to the recirculation circuit 202. For example, fluid received from the blender may be at a pressure in a range from 80 to 120 psi (e.g., 100 psi), and the fluid pump 108 may pressurize the fluid up to about 12,500 psi.

The fluid pump 108 includes an inlet 108*a* (which can be referred to as a low-pressure or suction side of the fluid pump 108) and an outlet 108*b* (which can be referred to a high-pressure or discharge side of the fluid pump 108). The inlet 108*a* may include various inlet components configured to receive fluid (e.g., low-pressure fluid) and to provide the fluid to one or more pressurization components (e.g., cylinders) of the fluid pump 108 for pressurization. For example, the inlet components may include one or more fluid conduits, one or more couplers for the fluid conduits, and/or an inlet manifold, among other examples. The inlet manifold may be configured to receive one or more fluid flows and to provide the fluid flow(s) to separate pressurization components (e.g., separate cylinders) of the fluid pump 108 for pressurization. The outlet 108*b* may include various outlet components configured to receive pressurized fluid (e.g., high-pressure fluid) from the pressurization component(s) of the fluid pump 108 and to discharge the pressurized fluid from the fluid pump 108. For example, the outlet components may include one or more fluid conduits, one or more couplers for the fluid conduits, and/or an outlet manifold, among other examples.

The outlet components of the outlet 108*b* may have a first pressure containment capability (e.g., a pressure limit above which bursting or leaking will occur) that is greater than a second pressure containment capability of the inlet components of the inlet 108*a*. For example, a thickness of the walls of the outlet components of the outlet 108*b* may be greater than a thickness of the walls of the inlet components of the inlet 108*a*. As an example, the outlet components of the outlet 108*b* may be capable of withstanding a pressure of at least 5,000 psi, at least 10,000 psi, or at least 12,000 psi without leaking or bursting. In contrast, the inlet components of the inlet 108*a* may be capable of withstanding a pressure of at most 1,000 psi, at most 500 psi, or at most 300 psi without leaking or bursting.

The recirculation circuit 202 may include one or more fluid conduits configured to direct high-pressure fluid discharged from the fluid pump 108 to a low-pressure side of the fluid pump 108, which may reduce power consumed by a prime mover (e.g., an engine, a motor, or the like) of the fluid pump 108 and/or facilitate faster ramping up of the fluid pump 108. For example, the recirculation circuit 202 may be opened while a transmission coupled to the fluid pump 108 is shifting from neutral to a first gear, and the recirculation circuit 202 may be closed when the shift from neutral to the first gear is achieved (e.g., when the first gear is fully engaged). The recirculation circuit 202 may be configured to direct fluid from the outlet 108*b* of the fluid pump 108 to the inlet 108*a* of the fluid pump 108. For example, the outlet 108*b* of the fluid pump 108 (e.g., an outlet manifold) may include a first port for discharging fluid to the manifold 110 and a second port for discharging fluid to the recirculation circuit 202. Similarly, the inlet 108*a* of the fluid pump 108 (e.g., an inlet manifold) may include a first port for receiving fluid from the blender 114 or another supplier of fluid and a second port for receiving fluid from the recirculation circuit 202. Fluid discharged from the fluid pump 108 may enter the recirculation circuit 202 upstream of the manifold 110.

The check valve 204 may be downstream of the fluid pump 108 between the fluid pump 108 and the manifold 110. The check valve 204 may also be downstream of an entrance into the recirculation circuit 202. The check valve 204 may be configured to allow fluid flow in a forward direction from the fluid pump 108 to the manifold 110 and to prevent fluid flow in a reverse direction from the manifold 110 to the fluid pump 108 or to the recirculation circuit 202 (the prevention of fluid flow refers to an intended property of the check valve 204, and in some cases the check valve 204 may not provide absolute prevention of fluid flow due to wear or defect). The check valve 204 may include a swing check valve, a ball check valve, a piston check valve, or the like.

The control valve 206 (e.g., a ball valve) and the choke valve 208 may be in the recirculation circuit 202 between the outlet 108*b* of the fluid pump 108 and the inlet 108*a* of the fluid pump 108. The recirculation circuit 202 may be configured to direct fluid from the outlet 108*b* of the fluid pump 108, via a first portion 202*a* (referred to herein as a "discharge portion") of the recirculation circuit 202 that is upstream of the control valve 206 and the choke valve 208, to the inlet 108*a* of the fluid pump 108 via a second portion 202*b* (referred to herein as a "suction portion") of the recirculation circuit 202 that is downstream of the control valve 206 and the choke valve 208. The control valve 206 and the choke valve 208 may be between the discharge portion 202*a* of the recirculation circuit 202 and the suction portion 202*b* of the recirculation circuit 202. The control valve 206 may be upstream of the choke valve 208, as shown. Alternatively, the choke valve 208 may be upstream of the control valve 206.

The control valve 206 may be configured for actuation between an open position and a closed position. In the open position, the control valve 206 permits pressurized fluid discharged from the fluid pump 108 to flow through the recirculation circuit 202. In the closed position, the control valve 206 prevents pressurized fluid discharged from the fluid pump 108 from flowing through the recirculation circuit 202 (the prevention of fluid flow refers to an intended property of the control valve 206, and in some cases the control valve 206 may not provide absolute prevention of fluid flow due to wear or defect).

The choke valve 208 may be configured to provide a pressure drop in the recirculation circuit 202 from the discharge pressure of the fluid pump 108 (e.g., from a high pressure above 10,000 psi to a low pressure below 300 psi). The choke valve 208 may include an orifice, and a size of the orifice may dictate an amount of fluid that can flow through the choke valve 208. The choke valve 208 may be in an adjustable configuration such that a size of the orifice may be varied to control a pressure of fluid in the recirculation circuit 202. For example, actuation of the choke valve 208 to a particular position may increase or decrease the size of the orifice to thereby increase or decrease, respectively, fluid flow through the choke valve 208.

The control valve 206 and the choke valve 208 may be communicatively connected (e.g., by wired connections or wireless connections) to the controller 130. For example, the controller 130 may provide position control commands to the control valve 206 indicating whether the control valve 206 is to be in the open position or the closed position. As another example, the controller 130 may provide position control commands to the choke valve 208 indicating a position, and thus an orifice size, of the choke valve 208.

The discharge pressure sensor 210 and the suction pressure sensor 212 may be in the recirculation circuit 202. The discharge pressure sensor 210 may be configured to detect a pressure of fluid in the discharge portion 202*a* of the recirculation circuit 202 upstream of the control valve 206 and the choke valve 208 (e.g., a pressure of fluid discharged from the outlet 108*b* of the fluid pump 108). For example, the discharge pressure sensor 210 may be between the outlet 108*b* of the fluid pump 108 and the control valve 206 and the choke valve 208. The suction pressure sensor 212 may be configured to detect a pressure of fluid in the suction portion 202*b* of the recirculation circuit 202 downstream of the control valve 206 and the choke valve 208 (e.g., a pressure of fluid entering the inlet 108*a* of the fluid pump 108 from the recirculation circuit 202). For example, the suction pressure sensor 212 may be between the control valve 206 and the choke valve 208 and the inlet 108*a* of the fluid pump 108. The discharge pressure sensor 210 and the suction pressure sensor 212 may be communicatively connected (e.g., by wired connections or wireless connections) to the controller 130. For example, the discharge pressure sensor 210 and the suction pressure sensor 212 may provide pressure information to the controller 130.

The controller 130 may be configured to perform operations associated with the recirculation circuit 202, as described herein. In particular, the controller 130 may perform operations to flush accumulated proppant from the recirculation circuit 202. For example, the proppant may accumulate in the recirculation circuit 202 when the control valve 206 is open while the fluid pump 108 is pumping fluid that is mixed with the proppant.

In a hydraulic fracturing stage, the controller 130 may cause an initiation of pumping of fluid by the fluid pump 108. In some examples, the controller 130 may cause the initiation of pumping of fluid by the fluid pump 108 after one or more other fluid pumps have previously begun pumping in the hydraulic fracturing stage. In other words, the controller 130 may cause the initiation of pumping of fluid by the fluid pump 108 after a start of the hydraulic fracturing stage (e.g., in the middle portion of the hydraulic fracturing stage). The fluid pump 108 may be brought online in the middle of the hydraulic fracturing stage to provide a pressure boost if a pressure generated by the other fluid pump(s) is insufficient (e.g., when one or more of the other fluid pump(s) is taken offline).

The controller 130 may cause the initiation of pumping of the fluid by the fluid pump 108 at a first time when proppant is being added to the fluid (e.g., in the middle of the hydraulic fracturing stage). Based on the initiation of pumping of the fluid, the controller 130 may cause opening of the control valve 206 to the open position (e.g., by transmitting a position control command to the control valve 206) to cause the fluid to flow through the recirculation circuit 202 (e.g., to assist in reducing power consumed by the fluid pump 108). For example, the controller 130 may cause opening of the control valve 206 at the first time when proppant is being added to the fluid. Opening of the control valve 206 to cause the fluid to flow through the recirculation circuit 202, when the proppant is being added to the fluid, may cause the proppant to accumulate in the recirculation circuit 202. As an example, respective recirculation circuits for the other fluid pump(s) that began the hydraulic fracturing stage may already be closed prior to the proppant being added to the fluid, to avoid the accumulation of proppant. However, the recirculation circuit 202 of the fluid pump 108, which shares fluid supplied by the blender 114 with the other fluid pump(s), may be open at this time due to the fluid pump 108 being brought online in the middle of the hydraulic fracturing stage.

In some examples, the controller 130 may identify the addition of the proppant to the fluid while the control valve 206 is open. For example, the controller 130 may obtain, from the controller 214, first information indicating the addition of the proppant to the fluid. The first information may indicate that proppant is currently being added to the fluid and/or indicate a time window in which proppant will be added to the fluid. Accordingly, the controller 130 may identify the addition of the proppant to the fluid while the control valve 206 is open, based on the first information.

Additionally, or alternatively, the controller 130 may identify the addition of the proppant to the fluid while the control valve 206 is open, using a sensor 216. The sensor 216 may be configured to detect a characteristic of the fluid, such as a viscosity of the fluid and/or a density of the fluid, among other examples. The controller 130 may determine that the fluid includes the proppant if the detected characteristic has a value in a first range (e.g., a viscosity or density in a first range of values), or the controller 130 may determine that the fluid does not include the proppant if the detected characteristic has a value in a second range (e.g., a viscosity or density in a second range of values). In some examples, the sensor 216 may include an optical sensor, such as a photodetector or a camera. The controller 130 may determine whether the fluid includes the proppant based on an image of the fluid (e.g., using a machine learning model), a color of the fluid, a light transmissivity of the fluid, or the like.

Based on identifying the addition of the proppant to the fluid while the control valve 206 is open, the controller 130 may set a flag (e.g., an internal flag of the controller 130). The flag, when set, may indicate the addition of the proppant to the fluid while the control valve 206 was open. Moreover, the flag, when set, may indicate that flushing of the recirculation circuit 202 is to be performed.

After opening of the control valve 206 (e.g., for a time duration), the controller 130 may cause closing of the control valve 206 to the closed position (e.g., by transmitting a position control command to the control valve 206). For example, as described herein, the controller 130 may cause closing of the control valve 206 based on a transmission coupled to the fluid pump 108 achieving a shift from neutral to a first gear and/or based on a driver speed of the prime mover satisfying a threshold speed that indicates that the fluid pump 108 has completed ramping up. Closing of the control valve 206 may halt the flow of the fluid in the recirculation circuit 202 while the fluid pump 108 continues pumping.

In some examples, the controller 130 may identify, after closing of the control valve 206, that the proppant is no longer being added to the fluid. For example, the controller 130 may obtain, from the controller 214, second information indicating that the proppant is no longer being added to the fluid. The second information may indicate that the addition of proppant to the fluid has halted and/or indicate a time window in which the proppant was added to the fluid. Accordingly, the controller 130 may identify, after closing of the control valve 206, that the proppant is no longer being added to the fluid based on the second information. Additionally, or alternatively, the controller 130 may identify that the proppant is no longer being added to the fluid using the sensor 216, in a similar manner as described above. In examples in which the first information indicates a time window in which the proppant will be added to the fluid or the second information indicates a time window in which the proppant was added to the fluid, the controller 130 may use the first information (without using the second information) or use the second information (without using the first information) to identify the addition of the proppant to the fluid while the control valve 206 is open and to identify that the proppant is no longer being added to the fluid. The first information and the second information may be referred to herein as "blender feedback."

In some examples, the controller 130 may receive a request to flush the recirculation circuit 202. For example, the controller 130 may receive the request to flush the recirculation circuit 202 at a second time when the proppant is no longer being added to the fluid. The request may be provided by an operator of the hydraulic fracturing system 100, such as via a user interface, an operator control, or the like. The controller 130 may receive the request to flush the recirculation circuit 202 in situations in which the blender feedback is not available. The flushing of the recirculation circuit 202 may be associated with pumping of hydraulic fracturing fluid without proppant (e.g., pure hydraulic fracturing fluid, such as water).

After closing of the control valve 206 and at the second time when the proppant is no longer being added to the fluid, the controller 130 may cause re-opening of the control valve 206. The controller 130 may cause re-opening of the control valve 206 to cause the fluid (with no proppant added) to flow through the recirculation circuit 202 to flush the recirculation circuit 202 of the proppant. In some implementations, the controller 130 may cause re-opening of the control valve 206, while the proppant is no longer being added to the fluid (e.g., based on identifying that the proppant is no longer being added), based on previously identifying the addition of the proppant to the fluid. For example, the controller 130 may cause re-opening of the control valve 206 based on the flag being set. In some implementations, the controller 130 may cause re-opening of the control valve 206 based on the request to flush the recirculation circuit 202.

The first time, when proppant is being added to the fluid, and the second time, when the proppant is no longer being added to the fluid, may be in the same hydraulic fracturing stage. For example, the first time may occur in the middle portion of the hydraulic fracturing stage and the second time may occur in the ending portion of the hydraulic fracturing stage. Alternatively, the first time, when proppant is being added to the fluid, may be in a first hydraulic fracturing stage, and the second time, when the proppant is no longer being added to the fluid, may be in a second hydraulic fracturing stage (e.g., a subsequent hydraulic fracturing stage). For example, the first time may occur in the middle portion of the first hydraulic fracturing stage, and the second time may occur in the starting portion or the ending portion of the second hydraulic fracturing stage.

As indicated above, FIG. 2 is provided as an example. Other examples may differ from what is described with regard to FIG. 2.

Figure 3:
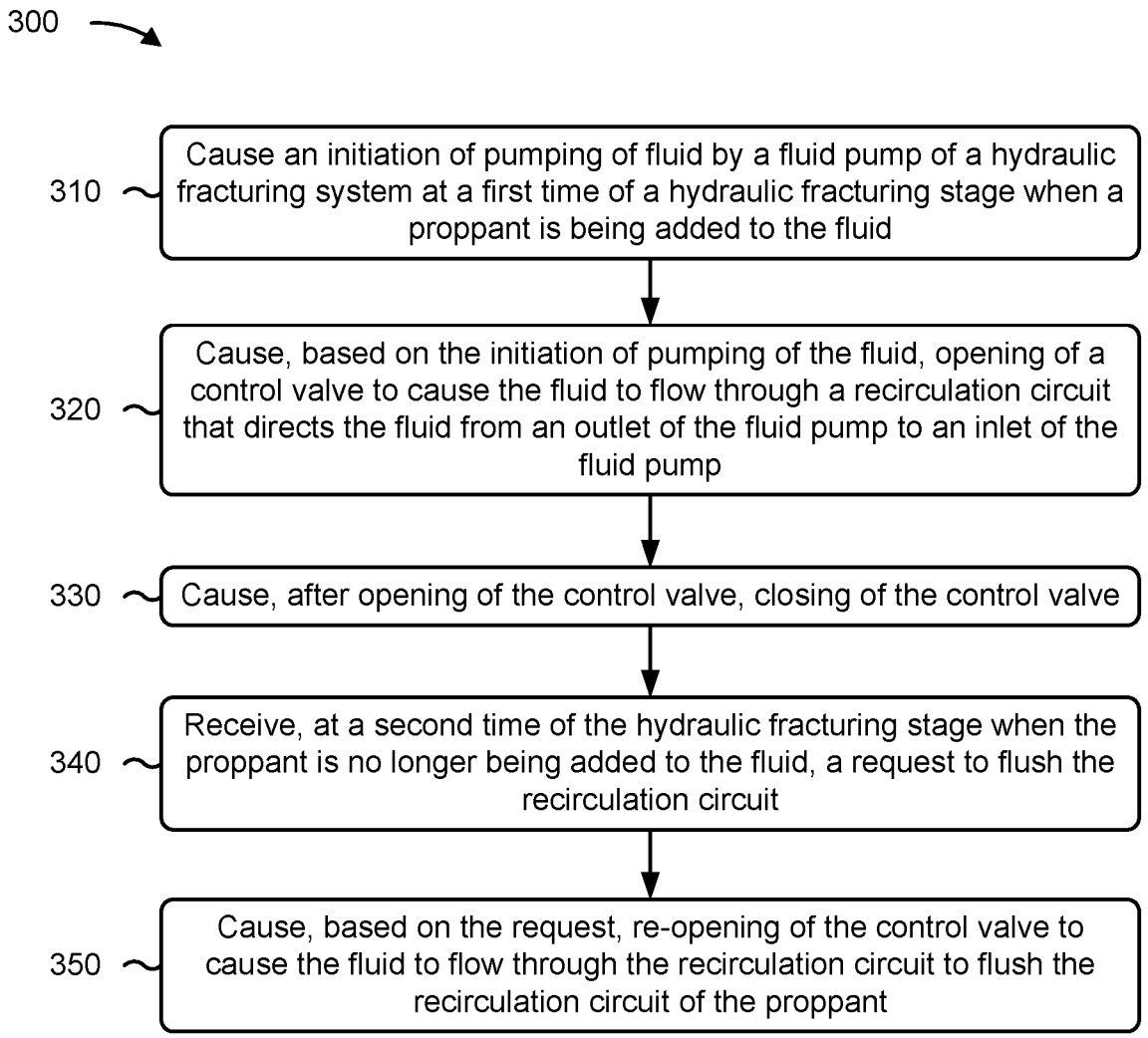
FIG. 3 is a flowchart of an example process associated with operation of a recirculation circuit for a fluid pump of a hydraulic fracturing system.

FIG. 3 is a flowchart of an example process 300 associated with operation of a recirculation circuit for a fluid pump of a hydraulic fracturing system. One or more process blocks of FIG. 3 may be performed by a controller (e.g., controller 130). Additionally, or alternatively, one or more process blocks of FIG. 3 may be performed by another device or a group of devices separate from or including the controller, such as another device or component that is internal or external to the hydraulic fracturing system 100 (e.g., controller 214). Additionally, or alternatively, one or more process blocks of FIG. 3 may be performed by one or more components of a device, such as a processor, a memory, an input component, an output component, and/or a communication component.

As shown in FIG. 3, process 300 may include causing an initiation of pumping of fluid by a fluid pump of a hydraulic fracturing system at a first time of a hydraulic fracturing stage when a proppant is being added to the fluid (block 310). For example, the controller may cause an initiation of pumping of fluid by a fluid pump of a hydraulic fracturing system at a first time of a hydraulic fracturing stage when a proppant is being added to the fluid, as described above. The first time of the hydraulic fracturing stage may be in a middle of the hydraulic fracturing stage. For example, the initiation of pumping of the fluid pump may be caused after one or more other pumps of the hydraulic fracturing system have previously begun pumping in the hydraulic fracturing stage.

As further shown in FIG. 3, process 300 may include causing, based on the initiation of pumping of the fluid, opening of a control valve to cause the fluid to flow through a recirculation circuit that directs the fluid from an outlet of the fluid pump to an inlet of the fluid pump (block 320). For example, the controller may cause, based on the initiation of pumping of the fluid, opening of a control valve to cause the fluid to flow through a recirculation circuit that directs the fluid from an outlet of the fluid pump to an inlet of the fluid pump, as described above. Opening of the control valve to cause the fluid to flow through the recirculation circuit when the proppant is being added to the fluid may cause the proppant to accumulate in the recirculation circuit.

As further shown in FIG. 3, process 300 may include causing, after opening of the control valve, closing of the control valve (block 330). For example, the controller may cause, after opening of the control valve, closing of the control valve, as described above. Closing of the control valve may be caused based on a transmission coupled to the fluid pump achieving a shift from neutral to a first gear.

As further shown in FIG. 3, process 300 may include receiving, at a second time of the hydraulic fracturing stage when the proppant is no longer being added to the fluid, a request to flush the recirculation circuit (block 340). For example, the controller may receive, at a second time of the hydraulic fracturing stage when the proppant is no longer being added to the fluid, a request to flush the recirculation circuit, as described above.

As further shown in FIG. 3, process 300 may include causing, based on the request, re-opening of the control valve to cause the fluid to flow through the recirculation circuit to flush the recirculation circuit of the proppant (block 350). For example, the controller may cause, based on the request, re-opening of the control valve to cause the fluid to flow through the recirculation circuit to flush the recirculation circuit of the proppant, as described above.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The control system described herein may be used with any hydraulic fracturing system that pressurizes hydraulic fracturing fluid using one or more fluid pumps. For example, the control system may be used with a hydraulic fracturing system that pressurizes hydraulic fracturing fluid using a fluid pump that utilizes a recirculation circuit. The control system is useful for removing proppant that has accumulated in the recirculation circuit. In particular, the control system may detect when hydraulic fracturing fluid with proppant has flowed through the recirculation circuit, and in response, the control system may subsequently open the recirculation circuit during pumping of hydraulic fracturing fluid without proppant to thereby flush proppant that accumulated in the recirculation circuit. In this way, the control system may reduce sand packing in the recirculation circuit and improve fluid flow through the recirculation circuit, thereby improving a performance of the recirculation circuit.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A pump system of a hydraulic fracturing system, comprising:

a fluid pump having an inlet and an outlet;

a recirculation circuit configured to direct fluid from the outlet of the fluid pump to the inlet of the fluid pump;

a control valve in the recirculation circuit; and a controller configured to:

cause opening of the control valve to cause the fluid to flow through the recirculation circuit;

identify an addition of a proppant to the fluid while the control valve is open;

identify, after closing of the control valve, that the proppant is no longer being added to the fluid; and cause, based on identifying the addition of the proppant to the fluid, re-opening of the control valve, while the proppant is no longer being added to the fluid, to cause the fluid to flow through the recirculation circuit to flush the recirculation circuit of the proppant.

2. The pump system of claim 1, wherein the controller is further configured to:

obtain, from an additional controller associated with a blender of the hydraulic fracturing system, information indicating the addition of the proppant to the fluid, wherein the controller is configured to identify the addition of the proppant to the fluid while the control valve is open based on the information.

3. The pump system of claim 1, wherein the controller is further configured to:

obtain, from an additional controller associated with a blender of the hydraulic fracturing system, information indicating that the proppant is no longer being added to the fluid, wherein the controller is configured to identify, after closing of the control valve, that the proppant is no longer being added to the fluid based on the information.

4. The pump system of claim 1, wherein the controller is further configured to:

cause pumping of the fluid pump after a start of a hydraulic fracturing stage.

5. The pump system of claim 1, wherein the controller is further configured to:

set a flag that indicates the addition of the proppant to the fluid while the control valve is open, wherein the controller is configured to cause re-opening of the control valve based on the flag being set.

6. The pump system of claim 1, wherein the control valve is configured for actuation between an open position and a closed position.

7. The pump system of claim 1, wherein the fluid pump is configured to discharge fluid to a manifold, and wherein the fluid discharged from the fluid pump is to enter the recirculation circuit upstream of the manifold.

8. The pump system of claim 1, wherein the control valve is between a discharge portion of the recirculation circuit and a suction portion of the recirculation circuit.

9. A control system, comprising:

a recirculation circuit configured to direct fluid from an outlet of a fluid pump of a hydraulic fracturing system to an inlet of the fluid pump;

a control valve in the recirculation circuit, wherein the control valve is between a discharge portion of the recirculation circuit and a suction portion of the recirculation circuit; and a controller configured to:

cause opening of the control valve to cause the fluid to flow through the recirculation circuit at a first time when proppant is being added to the fluid; and cause, after closing of the control valve and at a second time when the proppant is no longer being added to the fluid, re-opening of the control valve to cause the fluid to flow through the recirculation circuit to flush the recirculation circuit of the proppant.

10. The control system of claim 9, wherein the controller is further configured to:

identify an addition of the proppant to the fluid while the control valve is open; and identify, after closing of the control valve, that the proppant is no longer being added to the fluid.

11. The control system of claim 10, wherein the controller is further configured to:

obtain, from an additional controller associated with a blender of the hydraulic fracturing system, first information indicating the addition of the proppant to the fluid, wherein the controller is configured to identify the addition of the proppant to the fluid while the control valve is open based on the first information; and obtain, from the additional controller, second information indicating that the proppant is no longer being added to the fluid, wherein the controller is configured to identify, after closing of the control valve, that the proppant is no longer being added to the fluid based on the second information.

12. The control system of claim 10, wherein the controller is configured to identify the addition of the proppant to the fluid while the control valve is open using a sensor, and wherein the controller is configured to identify, after closing of the control valve, that the proppant is no longer being added to the fluid using the sensor.

13. The control system of claim 10, wherein the controller is further configured to:

set a flag that indicates the addition of the proppant to the fluid while the control valve is open, wherein the controller is configured to cause re-opening of the control valve based on the flag being set.

14. The control system of claim 9, wherein the first time and the second time are in a same hydraulic fracturing stage.

15. The control system of claim 9, wherein the first time is in a first hydraulic fracturing stage, and the second time is in a second hydraulic fracturing stage.

16. The control system of claim 9, wherein the controller is further configured to:

receive a request to flush the recirculation circuit, wherein the controller is configured to cause re-opening of the control valve based on the request.

17. A method, comprising:

causing, by a controller, an initiation of pumping of fluid by a fluid pump of a hydraulic fracturing system at a first time of a hydraulic fracturing stage when a proppant is being added to the fluid;

causing, by the controller and based on the initiation of pumping of the fluid, opening of a control valve to cause the fluid to flow through a recirculation circuit that directs the fluid from an outlet of the fluid pump to an inlet of the fluid pump;

causing, by the controller and after opening of the control valve, closing of the control valve;

receiving, by the controller and at a second time of the hydraulic fracturing stage when the proppant is no longer being added to the fluid, a request to flush the recirculation circuit; and causing, based on the request, re-opening of the control valve to cause the fluid to flow through the recirculation circuit to flush the recirculation circuit of the proppant.

18. The method of claim 17, wherein the first time of the hydraulic fracturing stage is in a middle of the hydraulic fracturing stage.

19. The method of claim 17, wherein the initiation of pumping of the fluid pump is caused after one or more other pumps of the hydraulic fracturing system have previously begun pumping in the hydraulic fracturing stage.

20. The method of claim 17, wherein closing of the control valve is caused based on a transmission coupled to the fluid pump achieving a shift from neutral to a first gear.

* * * * *